US012441522B2

(12) United States Patent
Meggelaars et al.

(10) Patent No.: US 12,441,522 B2
(45) Date of Patent: Oct. 14, 2025

(54) RECLOSABLE CONTAINER COMPRISING AN ASSEMBLY OF A BIN AND A SEPARATE COVER THAT IS DESIGNED TO CLOSE AND LOCK THE BIN

(71) Applicant: Curtec Nederland B.V., Rijen (NL)

(72) Inventors: Sigebertus Johannes Jacobus Jozef Meggelaars, Rijen (NL); Robertus Franciscus Cornelia Maria Aarts, Rijen (NL)

(73) Assignee: Curtec Nederland B.V., Rijen (NL)

( * ) Notice: Subject to any disclaimer, the term of this patent is extended or adjusted under 35 U.S.C. 154(b) by 0 days.

(21) Appl. No.: 18/219,212

(22) Filed: Jul. 7, 2023

(65) Prior Publication Data

US 2024/0010398 A1 Jan. 11, 2024

(30) Foreign Application Priority Data

Jul. 8, 2022 (NL) ..... 2032433

(51) Int. Cl.
*B65D 45/20* (2006.01)
*B65D 21/02* (2006.01)
(Continued)

(52) U.S. Cl.
CPC ..... *B65D 45/04* (2013.01); *B65D 21/0219* (2013.01); *B65D 45/18* (2013.01);
(Continued)

(58) Field of Classification Search
CPC .. B65D 2543/0025; B65D 2543/00666; B65D 2543/00861; B65D 2543/00833;
(Continued)

(56) References Cited

U.S. PATENT DOCUMENTS 3,759,415 A * 9/1973 Cloyd ..... B65D 43/0212 220/792
4,071,064 A * 1/1978 Saul ..... B65D 15/22 220/324
(Continued)

FOREIGN PATENT DOCUMENTS

DE 2444416 A1 * 4/1976
DE 2521252 A1 * 4/1977
(Continued)

*Primary Examiner* — Allan D Stevens
(74) *Attorney, Agent, or Firm* — The Webb Law Firm

(57) ABSTRACT

Provided is a reclosable container including an assembly of a bin and a separate cover that is designed to close and lock the bin.
The bin includes a bottom wall and a vertical side wall connected thereto, said side wall including an upper zone that surrounds an access opening of the bin.
The cover includes an upper surface that is dimensioned to cover the access opening of the bin. A perimeter of the upper surface is provided with a cover profile, said cover profile being formed complementary to the upper zone of the bin, so that the cover profile can be placed abutting on the upper zone of the bin in order to close the access opening of the bin.
Two opposite outer sides of the upper zone are each provided with a primary coupling body for locking the cover when the cover is placed in the closing position on the bin. Two opposite outer sides of the cover profile are each provided with a side flap that is provided with a window that is designed to engage on the primary coupling body so that primary locking between cover and bin is achieved. The side flap is connected tiltably to the cover profile in such a way that the side flap can be placed in a locking position and in an unlocking position.

15 Claims, 4 Drawing Sheets

(51) Int. Cl.
*B65D 45/04* (2006.01)
*B65D 45/18* (2006.01)

(52) U.S. Cl.
CPC .... *B65D 45/20* (2013.01); *B65D 2543/00296* (2013.01); *B65D 2543/00574* (2013.01); *B65D 2543/00666* (2013.01); *B65D 2543/00694* (2013.01); *B65D 2543/00805* (2013.01)

(58) Field of Classification Search
CPC ..... B65D 2543/00842; B65D 45/04; B65D 45/20; B65D 45/22; B65D 43/0212; E05B 15/0093; E05B 77/06; Y10T 292/0944; Y10T 292/0902; Y10T 292/0905; Y10T 292/0937; Y10T 292/0939; Y10T 292/094; Y10T 292/1063; Y10T 292/1064; Y10T 292/1068; Y10T 292/1072; E05C 19/06; E05C 19/063
USPC ..... 220/324
See application file for complete search history.

(56) References Cited

U.S. PATENT DOCUMENTS

| | | | | | |
|---|---|---|---|---|---|
| 5,695,087 | A * | 12/1997 | Tutton | ..... | B65D 45/22 206/508 |
| 2018/0118431 | A1 | 5/2018 | Hayakawa et al. | | |
| 2021/0284398 | A1 * | 9/2021 | Valderrama | ..... | B65D 43/022 |

FOREIGN PATENT DOCUMENTS

| | | | | | |
|---|---|---|---|---|---|
| DE | 2549604 | A1 * | 5/1977 | | |
| DE | 202023002712 | U1 * | 4/2024 | | |
| EP | 1508528 | A1 | 2/2005 | | |
| EP | 3653524 | A1 * | 5/2020 | | |
| EP | 3960650 | A1 | 3/2022 | | |
| JP | 2019137452 | A | 8/2019 | | |
| KR | 200396084 | Y1 * | 9/2005 | | |
| NL | 9201550 | A * | 4/1994 | ..... | B65D 11/10 |

* cited by examiner

RECLOSABLE CONTAINER COMPRISING AN ASSEMBLY OF A BIN AND A SEPARATE COVER THAT IS DESIGNED TO CLOSE AND LOCK THE BIN

CROSS-REFERENCE TO RELATED APPLICATION

This application claims priority to The Netherlands Patent Application No. 2032433 filed Jul. 8, 2022, the disclosure of which is hereby incorporated by reference in its entirety.

BACKGROUND OF THE INVENTION

Field of the Invention

The present invention relates to a reclosable container comprising an assembly of a bin and a separate cover that is designed to close and lock the bin.

Description of Related Art

Reclosable containers are generally known in this technical field, and are available commercially in a number of variants.

The invention relates to an improvement of a reclosable container that is available commercially, and an assembly comprising a bin and a separate cover that is designed to close and lock the bin,

- wherein the bin comprises a bottom wall and a vertical side wall connected thereto, said side wall comprising an upper zone that surrounds an access opening of the bin;
- wherein the cover comprises an upper surface that is dimensioned to cover the access opening of the bin, wherein a perimeter of the upper surface is provided with a cover profile, said cover profile being formed complementary to the upper zone of the bin, so that the cover profile can be placed abutting on the upper zone of the bin in order to close the access opening of the bin;
- wherein two opposite outer sides of the upper zone are each provided with a primary coupling body for locking the cover when the cover is placed in the closing position on the bin;
- and wherein two opposite outer sides of the cover profile are each provided with a side flap that is provided with a window that is designed to engage on the primary coupling body so that a primary locking between cover and bin is achieved, wherein the side flap is connected tiltably to the cover profile in such a way that the side flap can be placed in a locking position and in an unlocking position.

A reclosable container of this kind, known from the prior art, provides reliable closure of the bin because the cover can be locked in the closing position based on engagement between on the one hand the side flaps of the cover and on the other hand the respective primary coupling bodies of the bin. The side flaps in addition allow this engagement to be removed if required, to unlock the closure. Such a container is thus reclosable, in the sense that the container can be closed and opened repeatedly, by placing the side flap in the locking position and the unlocking position, respectively.

Usually the primary locking is in this case based on a primary coupling body that is configured as a bulging body with an outer contour, which is a clamping fit within an inner edge of the window of the side flap when this is put in the locking position. In order to bring about locking, a light force must be exerted on the side flap in order to put this in the locking position during tilting and to clamp the coupling body shut. For the reverse movement, again a light force is necessary in order to overcome the clamping that has been brought about between the window and the coupling body, so that the side flap is put in the unlocking position.

In normal use of this type of reclosable container, owing to the primary locking, reliable closure is obtained, which cannot open spontaneously, because this requires a specific tilting of the side flaps, wherein a light force must be exerted by the user.

In practice, however, it has been established that a container of this type, which is locked shut and whose interior space is filled with material, may open unintentionally during a fall of the container onto the ground because the primary locking springs open as a result of forces that are exerted on the container as it falls onto the ground.

This unwanted opening occurs in particular when the container falls upside down on the ground. When it falls like this, the upper zone of the bin as well as the cover are deformed slightly, while the two components move relative to each other temporarily, so that the mutual engagement of the two components is no longer effective, and the primary locking springs open.

The undesirable springing open of the primary locking is also a consequence of the fact that during falling of the container while upside down, the material with which the container is filled exerts a relatively large impulse on the cover and a relatively small impulse on the bin.

The unintentional springing open of the locking when the container is dropped is not only a drawback in the general sense: in specific cases it is even very undesirable. For example, the springing open is very undesirable when the container contains material that is very valuable, or when the nature of the material poses a risk to people or the environment if it is released from the container.

In such cases it is often obligatory for the container to meet a quality standard for very high reliability of the locked closure, as defined for general guidelines for the packing of hazardous substances (an example of this is the international ADR legislation, which is applicable to transport by road).

A reclosable container of the type that is used in the prior art cannot, however, satisfy a high quality standard like this.

SUMMARY OF THE INVENTION

The invention aims to minimize or even completely remove the aforementioned drawbacks of the known reclosable container.

According to a first aspect of the invention, the above aim is achieved by supplying a reclosable container of the aforementioned type,

- wherein the side flap is additionally provided on the inside with a secondary coupling body which extends from the inside and which, when the side flap is put in the locking position, projects through a locking passage in the cover profile, and moreover extends into a receiving space that is provided on each of the two opposite outer sides of the upper zone of the bin, said secondary coupling body being of bendable configuration, so that:
  - i) in a static state of the locked assembly of the bin and the cover, the secondary coupling body is unbent and occupies an inactive position relative to the locking passage, and
  - ii) in a dynamic state of the locked assembly of the bin and the cover wherein the assembly is exposed to an impulse, as a result of the impulse the secondary coupling body is bent towards an active position so that the secondary coupling body engages behind the inner edge of the locking passage, so that a secondary locking between cover and bin is achieved.

The principle of the invention is thus based on providing the container with an additional, secondary coupling body that functions as falling protection in a dynamic state of the container wherein the assembly of bin and cover is exposed to an impulse. For example, said impulse occurs when the locked assembly falls onto the ground.

As soon as the secondary coupling body is exposed to bending forces as a result of the impulse, secondary locking is brought about, which forms extra locking of the assembly, so that undesirable springing open of the primary locking is prevented. The secondary locking thus ensures that the assembly of the cover and the bin remains locked together, even when the assembly is exposed to an impulse for example such as during a fall onto the ground.

As was discussed above for the prior art, it also applies to the invention that the primary locking can be configured in a suitable manner by means of a primary coupling body that is formed as a bulging body with an outer contour that is a clamping fit within an inner edge of the window of the side flap when the side flap is put in the locking position.

A generally suitable design for the container is a cube shape or a derivative thereof. The cube shape is then dimensioned so that the container volume is for example in the region of litres.

For the reclosable container according to the invention, it is preferable that the dynamic state (ii) of the locked assembly comprises a fall of the locked assembly onto the ground, in particular wherein during the fall, the locked assembly ends up upside down on the ground, and more particularly wherein during the fall the cover comes into direct contact with the ground.

It was found from fall simulations that precisely in this dynamic state of a fall of the assembly onto the ground, there is a great risk of the primary locking springing open through the impulse of the fall, so that the assembly is no longer locked closed, with all the drawbacks of that.

More preferably, it applies to the reclosable container according to the invention that in the dynamic state (ii) of the locked assembly, the impulse causes the receiving space to impact on the secondary coupling body, and preferably a roof part of the receiving space impacts on an upper side of the secondary coupling body.

The receiving space is in itself very suitable for being configured so that it impacts on the secondary coupling body almost directly when the assembly is exposed to the impulse. In a fall wherein the assembly ends up with the cover on the ground, this collision is particularly active when a roof part of the receiving space impacts on an upper side of the secondary coupling body.

It is additionally advantageous when it applies to the reclosable container according to the invention that in the dynamic state (ii) of the locked assembly, the secondary coupling body is bent downwards.

The term "downwards" means in this context a direction from the upper side of the container that contains the cover, to the underside of the container, i.e. the bottom wall of the bin. Said bending takes place, for example, when the receiving space impacts on an upper side of the secondary coupling body.

Preferably, for the reclosable container according to the invention, the secondary coupling body is provided with a projection that engages behind the inner edge of the locking passage in the dynamic state (ii) of the locked assembly, said projection preferably being configured as a downward-directed projection provided on an underside of the secondary coupling body.

This projection is a simple and effective way of providing engagement for secondary locking.

It is very effective for the reclosable container according to the invention that in static state (i) of the locked assembly, an upper side of the secondary coupling body is located at a short distance from an upper part of the receiving space, for example at a distance from mm to 2.5 mm, and the underside of the secondary coupling body is located at a short distance from the inner edge of the locking passage, for example at a distance from 0.2 mm to 2.5 mm.

By maintaining these relatively short distances apart, it is ensured that during the sudden impulse that is caused by a fall, the secondary locking becomes active very quickly, because the collision between the receiving space and coupling body takes place quickly, and the bending as a result of the collision quickly leads to the assuming of an active locking position of the coupling body behind the locking passage.

Owing to the quick activation of the secondary locking, the risk is further reduced that after a fall on the ground the cover unintentionally comes away from the bin through the springing open of the primary locking, while the secondary locking does not yet function adequately.

In a preferred embodiment of the reclosable container according to the invention, the receiving space comprises a roof part, which is directed slanting downwards towards an access side of the receiving space.

The term "downwards" in this context relates to a direction as already explained above, i.e. from the upper side of the container that comprises the cover, to the underside of the container, i.e. the bottom wall of the bin.

This configuration of the roof part contributes to the adequate activation of the secondary locking in the dynamic state.

In another preferred embodiment of the reclosable container according to the invention, the secondary coupling body comprises an upper side, said upper side in the static state (i) of the locked assembly being directed slanting downwards towards the side flap.

This configuration of the upper side further contributes to adequate activation of the secondary locking in the dynamic state. This applies in particular in combination with a receiving space whose roof part is directed slanting downwards.

It is particularly preferred for the reclosable container according to the invention that in static state (i) of the locked assembly, the side flap is movable between an unlocked and a locked position, and in said movement the secondary coupling body goes past the inner edge of the locking passage without coming into contact with it and the secondary coupling body also does not come into contact with the receiving space.

Thus, repeated closing and opening of the container is possible by respectively locking and unlocking the primary locking by moving the side flap, without the secondary coupling body being bent. It is only after a fall with impact that the secondary coupling body will be bent and the secondary locking is thus activated.

According to a second aspect of the invention, it relates to an alternative embodiment of the reclosable container, which offers the same functionality and technical advantages as a reclosable container according to the first aspect of the invention.

This alternative embodiment aims to combine the functions of the separate primary and secondary coupling bodies in one universal coupling body that achieves both the primary and the secondary locking by engagement on the receiving space and the locking passage, respectively.

Thus, according to this second aspect, the invention relates to:

a reclosable container comprising an assembly of a bin and a separate cover that is designed to close and lock the bin, wherein the bin comprises a bottom wall and a vertical side wall connected thereto, said side wall comprising an upper zone that surrounds an access opening of the bin;

wherein the cover comprises an upper surface that is dimensioned to cover the access opening of the bin, wherein a perimeter of the upper surface is provided with a cover profile, said cover profile being formed complementary to the upper zone of the bin, so that the cover profile can be placed abutting on the upper zone of the bin in order to close the access opening of the bin;

wherein two opposite outer sides of the cover profile are each provided with a side flap wherein the side flap is connected tiltably to the cover profile in such a way that the side flap can be placed in a locking position and in an unlocking position;

characterized in that the side flap is provided on an inner side with a universal coupling body, which extends from the inner side and which, when the side flap is put in the locking position, projects through a locking passage in the cover profile, and extends into a receiving space that is provided on each of the two opposite outer sides of the upper zone of the bin, wherein the universal coupling body is of a bendable configuration, so that:

i) in a static state of the locked assembly of the bin and the cover, the universal coupling body occupies an inactive position relative to the locking passage, while it is in close contact with the receiving space and thus achieves a primary locking, and ii) in a dynamic state of the locked assembly of the bin and the cover wherein the assembly is exposed to an impulse, the universal coupling body being bent as a result of the impulse to an active position so that the universal coupling body engages behind the inner edge of the locking passage, so that a secondary locking between cover and bin is achieved.

The invention according to this second aspect achieves the same advantages as already described above for the invention according to the first aspect: in the static state, primary locking is achieved, whereas in the dynamic state, secondary locking is achieved, which functions as fall protection.

Also for the alternative embodiment according to the second aspect of the invention, some preferred embodiments are applicable, which are defined in more detail in the appended dependent claims. These preferred embodiments for the second aspect of the invention are derived similarly, from the preferred embodiments already discussed above that relate to the first aspect of the invention. For further technical aspects of these embodiments, reference should therefore be made to the respective discussion above.

Some further embodiments of the reclosable container according to the second aspect of the invention, comprise one or more of the next preferred features:

the receiving space comprises a roof part that is directed slanting downwards towards an access side of the receiving space;

the universal coupling body comprises an upper side, said upper side, in the static state (i) of the locked assembly, being directed slanting downwards towards the side flap;

in static state (i) of the locked assembly, the side flap is movable between an unlocked and a locked position, and during this movement the universal coupling body goes past the inner edge of the locking passage without coming into contact with it and the universal coupling body.

In a specific, practical embodiment of the reclosable container according to the first aspect of the invention, the two opposite outer sides of the upper zone are each provided with two primary coupling bodies, and two receiving spaces, and each side flap is provided with two secondary coupling bodies and two locking passages.

This double configuration of primary and secondary locking on each of the two opposite outer sides of the container gives optimum, reliable action of the primary and secondary locking per outer side.

By analogy with the foregoing, in a specific, practical embodiment of the reclosable container according to the second aspect of the invention, the two opposite outer sides of the upper zone are each provided with two receiving spaces, and each side flap is provided with two universal coupling bodies and two locking passages.

In a further, practical embodiment of the reclosable container according to the first or second aspect of the invention, the two opposite outer sides of the upper zone are each provided with a handle for lifting the container.

In an attractive, practical embodiment of the reclosable container according to the first or second aspect of the invention, protruding projections are provided at several positions on the outer side of the bin, particularly at vertices of the bin.

These projections allow a number of bins that have not yet been provided with a cover to be stacked nesting on each other, wherein some gap is maintained between two bins stacked one above another, which is advantageous in practice.

In a further, practical embodiment of the reclosable container according to the first or second aspect of the invention, the upper surface of the cover has a recessed surface relative to the perimeter of the upper surface, said recessed surface being of a shape that is complementary to an underside of the bottom wall of the bin.

Thus, a number of containers can be stacked on one another easily and in a stable manner.

It is also preferred for the cover and/or the bin of the reclosable container according to the first or second aspect of the invention to be manufactured of high-density polyethylene (HDPE).

A polymer material such as HDPE is on the one hand very suitable for injection moulding of a cover and a bin, and on the other hand HDPE has sufficient elastic properties to allow the cover and the bin to bend without breaking during impact from a fall.

An alternative polymer material that may be considered is polypropylene (PP).

BRIEF DESCRIPTION OF THE DRAWINGS

The invention will be explained in more detail on the basis of the appended figures showing preferred embodiments, wherein.

DESCRIPTION OF THE INVENTION

Figure 1:
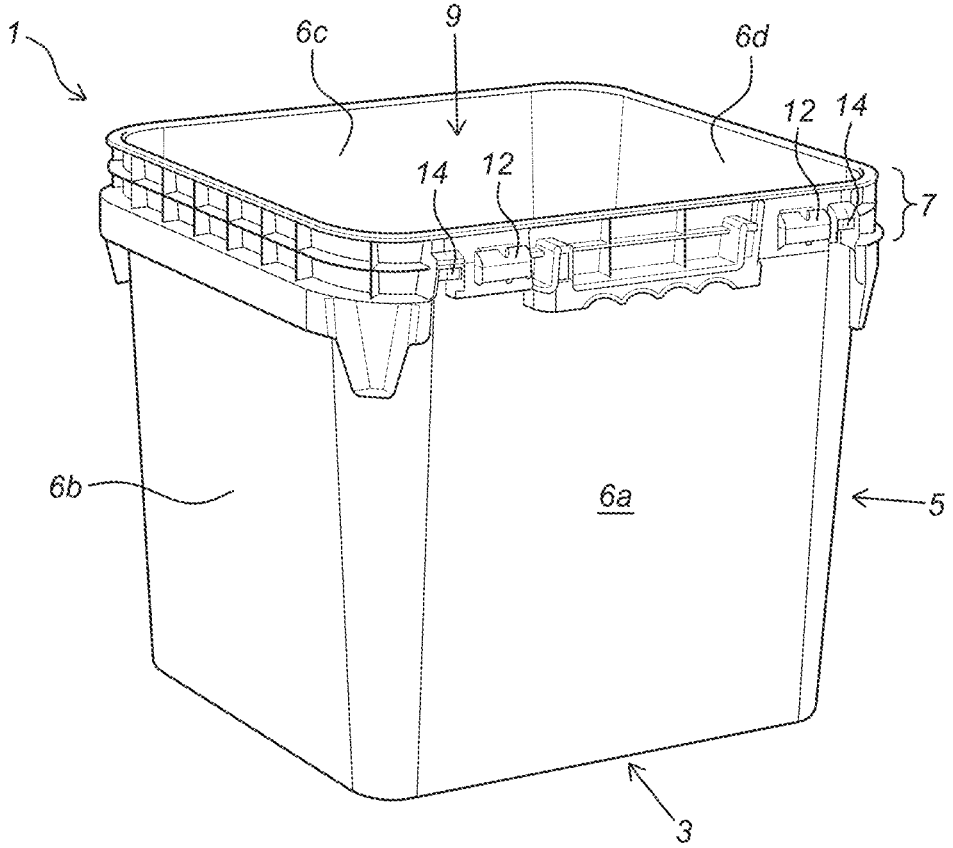
FIG. 1 shows a bin that is suitable for a reclosable container according to a first aspect of the invention.

FIG. 1 shows a bin 1, which comprises a bottom wall 3 (not visible) on the underside, and a vertical side wall 5 connected thereto, which is made up of four side parts 6*a*, 6*b*, 6*c*, 6*d* joined together, which are perpendicular to each other. The side wall 5 comprises an upper zone 7, which surrounds an access opening 9 of the bin 1. Two opposite outer sides of the side parts 6*a* and 6*c* are provided in the upper zone 7 with two primary coupling bodies 12 for the locking of a cover that is placed on the bin 1 in the closing position. These primary coupling bodies 12 are configured as rounded blocks. Besides the primary coupling bodies 12, two receiving spaces 14 are provided per side part 6*a* and 6*c*, for interaction with a secondary coupling body of a cover according to the invention.

Figure 2:
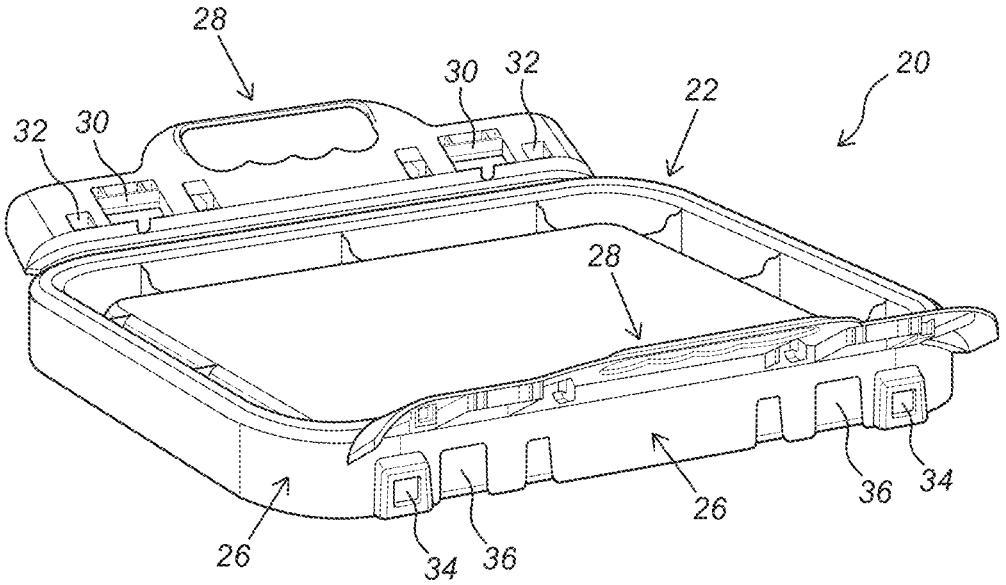
FIG. 2 shows a cover that is suitable for a reclosable container according to a first aspect of the invention.

FIG. 2 shows a cover 20 that is suitable for placing on and closing the access opening 9 of bin 1 according to FIG. 1. For this purpose, the cover 20 comprises an upper surface 22 that is dimensioned to cover the access opening 9 of the bin 1, wherein a perimeter of the upper surface 22 is provided with a cover profile 26 that surrounds the whole upper surface 22. This cover profile 26 is shaped to be complementary to the upper zone 7 of the bin 1, so that the cover profile can be placed abutting on the upper zone 7 of the bin 1 in order to close the access opening of the bin.

Two opposite outer sides of the cover profile 26 are each provided with a side flap 28, which is provided with two windows 30 that are designed to engage on the primary coupling body 12 of the bin 1 so that primary locking between cover 20 and bin 1 is achieved, wherein the side flap 28 is connected tiltably to the cover profile 26 in such a way that the side flap 28 may be placed in a locking position and in an unlocking position. In FIG. 2, the side flaps 28 are shown in an upward-folded state, said state corresponding to an unlocking position. In addition, the side flap 28 is provided on an inner side with two secondary coupling bodies 32, which extend from the inner side.

The two sides of the cover profile, which are provided with a side flap 28, in addition comprise in the cover profile 26 two notches 36, which offer free space for the primary coupling bodies 12, and two locking passages 34, which offer free space for the secondary coupling bodies 32 of the respective side flap 28 to pass through.

Figure 3:
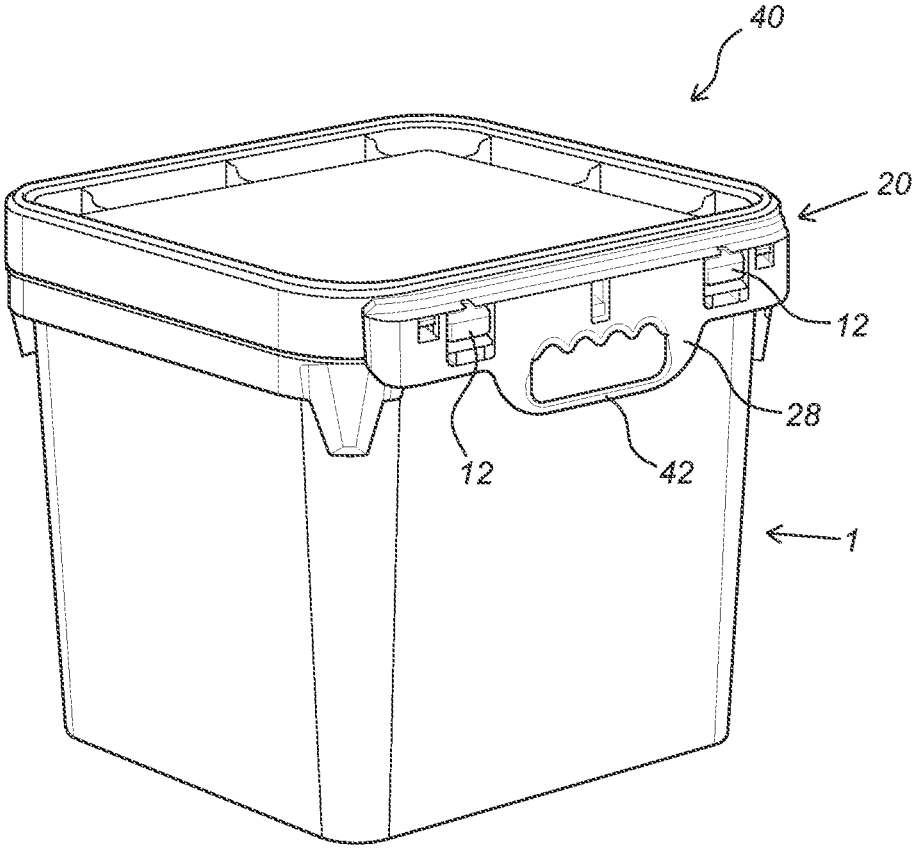
FIG. 3 shows a reclosable container according to the invention, which is assembled from a bin and a cover as shown in FIGS. 1 and 2 wherein the container is in the closed and locked state.

FIG. 3 shows a reclosable container 40, which is assembled from a bin 1 and a cover 20 fitted thereon, said bin and cover being configured according to the respective FIGS. 1 and 2. The cover 20 closes the access opening of bin 1, while the bin 1 and cover 20 are also locked together. To achieve locking, side flaps 28 are folded downwards and are thus placed in the locking position, wherein the primary coupling bodies 12 of the bin 1 are enclosed and clamped within the respective windows of the side flaps 28. The side flaps 28 are provided with a lip structure 42, with which a user can easily grasp the side flaps in order to bring these into an unlocking position by tilting them upwards.

Figure 4:
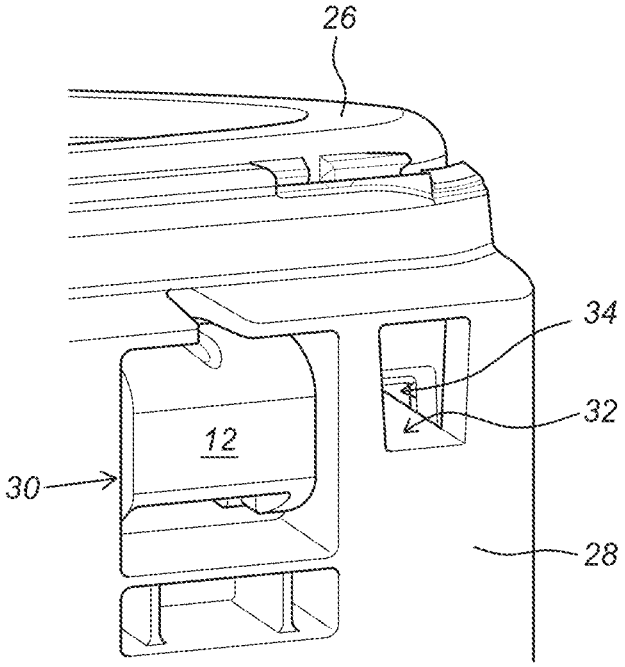
FIG. 4 shows a detail of a cover and a bin in the locked state according to FIG. 3.

FIG. 4 shows a detail of the locked state of the cover 20 and bin 1 as shown in FIG. 3. The cover profile 26 and the side flap 28 connected thereto can be seen in the locking position, wherein the primary coupling body 12 of bin 1 is enclosed and clamped within the window of the side flap 28. Meanwhile the secondary coupling body 32 projects freely through locking passage 34, which is provided in the cover profile 26.

FIG. 4 thus shows primary locking of cover 20 and bin 1, whereas the secondary locking is not active. This situation occurs in a static state of the locked assembly of the bin and the cover.

Figure 5:
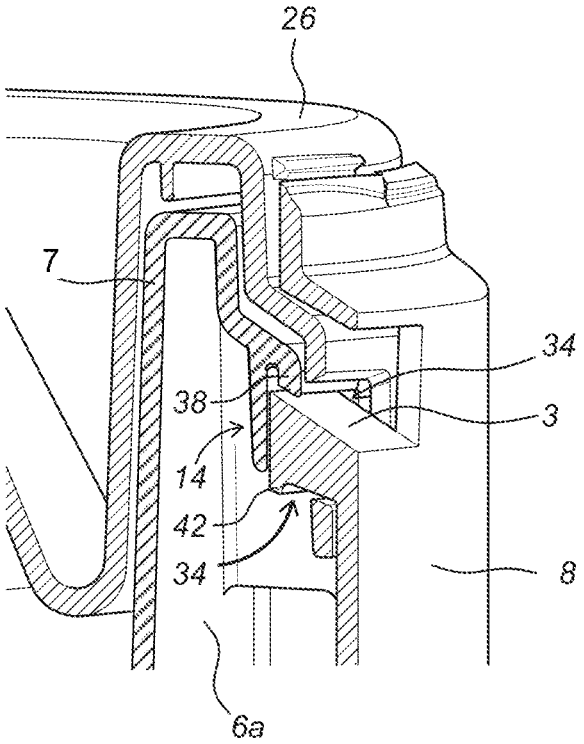
FIG. 5 shows a cross-section of a cover and a bin in the locked state according to FIG. 4.

FIG. 5 shows further details of the locked situation according to FIG. 4, wherein the secondary coupling body 32 projects through the locking passage 34, and extends into the receiving space 14. This receiving space has an upper side, which comprises a roof part 38 that is directed slanting downwards towards an access side of the receiving space 14. The secondary coupling body 32 has a comparable slanting orientation on the upper side, and is provided with a projection 42 on the underside. The space between the upper side of the secondary coupling body 32 and the roof part 38 is small, for example 0.2 mm to 1.5 mm. The space between the underside of the secondary coupling body 32 and the bottom edge of the locking passage 34 is also small, for example 0.2 mm to 1.5 mm.

Figure 6:
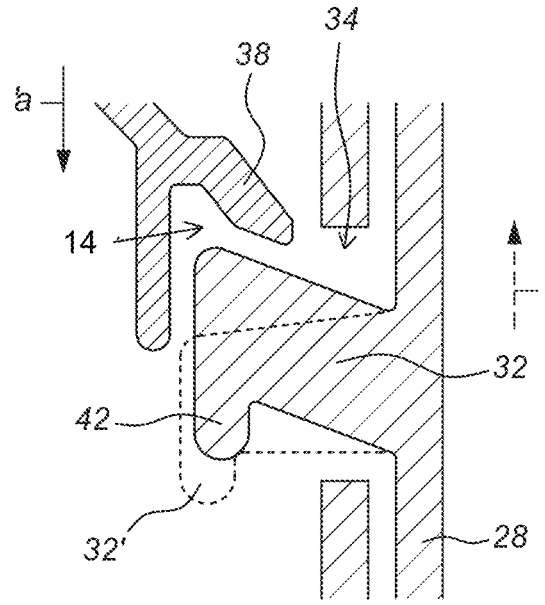
FIG. 6 shows schematically the relevant components from the cross-section according to FIG. 5, which interact with one another during a fall onto the ground.

FIG. 6 shows schematically the relevant components from the cross-section according to FIG. 5, which will interact with each other during a fall of a filled container onto the ground, wherein the container ends up on the cover side. The situation shown is the initial situation shortly before the moment when the container comes into contact with the ground. At the moment when the filled container comes into contact with the ground, on account of the weight of the material that is present in the container, the cover will be subject to a larger impulse than the bin, so that the cover will move relatively in a direction a relative to the bin. Put the other way round, this may also be stated as an opposite motion a' of the bin relative to the cover. As a consequence of these movements, there is an increased risk of the primary locking coming undone, as has already been described above.

In order to overcome the sudden detachment of the primary locking, the invention comprises secondary locking based on the components that are shown in FIG. 6, which works as follows: On account of the relative motion a' of the bin relative to the cover, the component of the bin shown, i.e. the receiving space 14 with roof part 38, will also move downwards (in direction of motion a) relative to the secondary coupling body 32 and locking passage 34, which form part of the cover. During this motion, the roof part 38 will collide with the upper side of the secondary coupling body 32, wherein the coupling body 32 bends downwards to a position that is shown with a dotted line as 32'. In this position, the projection 42 on the underside of the coupling body 32 is in a lower position than the bottom edge of locking passage 34, so that the projection 42 and locking passage 34 hook behind each other. Thus, secondary locking is brought about during a fall onto the ground, which functions as fall locking so that the risk of the cover becoming detached from the bin during a fall is minimized.

Figure 7:
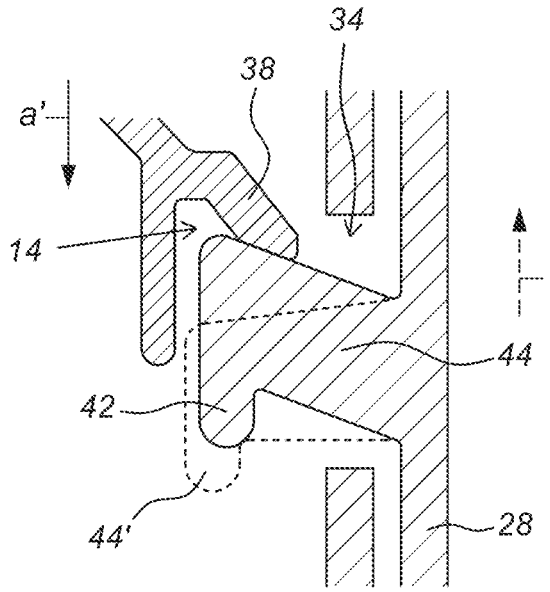
FIG. 7 shows the same components as in FIG. 6, for an alternative embodiment of the reclosable container according to a second aspect of the invention.

FIG. 7 shows the same components as in FIG. 6, for an alternative embodiment of the reclosable container according to a second aspect of the invention. Components in FIG. 7 that correspond to those in FIG. 6 are indicated with the same reference numbers.

Otherwise than in the embodiment of the container according to the first aspect of the invention that is shown in the preceding figures, the container according to the second aspect comprises a universal coupling body 44, which is able in itself to bring about primary and secondary locking in a static situation and in a dynamic situation, respectively. With this universal coupling body, the container no longer needs to be provided with separate primary coupling bodies and windows interacting therewith, which may thus be omitted if so desired.

In the initial situation shown, just before the impact of a fall onto the ground, the upper side of the universal coupling body 44 is in clamping contact with roof part 38 of the receiving space 14, so that the upper side of the universal coupling body 44 is locked behind the roof part 38. Thus, the universal coupling body 44 brings about primary locking with the roof part 38: it takes some force to tilt the side flap 28 outwards in order to remove the clamping contact.

At the moment of impact on the ground, the relative motion a' of the bin relative to the cover will push the universal coupling body 44 downwards, to the state shown with a dotted line as 44'. In this position, the projection 42 on the underside of the coupling body 32 is in a lower position than the bottom edge of locking passage 34, so that the projection 42 and locking passage 34 hook behind each other. Thus, universal coupling body 44 is able to bring about secondary locking, which functions as fall locking so that the risk of the cover becoming detached from the bin during a fall is minimized.

The invention claimed is:

1. A reclosable container comprising an assembly of a bin and a separate cover that is designed to close and lock the bin, wherein the bin comprises a bottom wall and a vertical side wall connected thereto, said side wall comprising an upper zone that surrounds an access opening of the bin;

wherein the cover comprises an upper surface that is dimensioned to cover the access opening of the bin, wherein a perimeter of the upper surface is provided with a cover profile, said cover profile being formed complementary to the upper zone of the bin, so that the cover profile can be placed abutting on the upper zone of the bin in order to close the access opening of the bin;

wherein two opposite outer sides of the upper zone are each provided with a primary coupling body for locking the cover when the cover is placed in a closing position on the bin;

and wherein two opposite outer sides of the cover profile are each provided with a side flap that is provided with a window that is designed to engage on the primary coupling body so that a primary locking between cover and bin is achieved, wherein each side flap is connected tiltably to the cover profile in such a way that each side flap can be placed in a locking position and in an unlocking position, wherein the bin and cover form a locked assembly when both side flaps are in the locking position;

wherein each side flap is in addition provided on an inner side with a secondary coupling body that extends from the inner side and, when each side flap is put in the locking position, projects through a locking passage in the cover profile, and extends thereby into a receiving space that is provided on each of the two opposite outer sides of the upper zone of the bin, wherein the secondary coupling body is of a bendable configuration, so that:

i) in a static state of the locked assembly of the bin and the cover, the secondary coupling body is unbent and occupies an inactive position relative to the locking passage, and ii) in a dynamic state of the locked assembly of the bin and the cover wherein the assembly is exposed to an impulse, as a result of which the secondary coupling body is bent towards an active position so that the secondary coupling body engages behind an inner edge of the locking passage, so that a secondary locking between cover and bin is achieved.

2. The reclosable container according to claim 1, wherein the dynamic state (ii) of the locked assembly comprises a fall of the locked assembly onto the ground, wherein during the fall the locked assembly ends up upside down on the ground, and wherein during the fall the cover comes into direct contact with the ground.

3. The reclosable container according to claim 1, wherein, in the dynamic state (ii) of the locked assembly, the impulse has the result that the receiving space collides with the secondary coupling body, wherein a roof part of the receiving space collides with an upper side of the secondary coupling body.

4. The reclosable container according to claim 1, wherein in the dynamic state (ii) of the locked assembly, the secondary coupling body is bent downwards.

5. The reclosable container according to claim 1, wherein the secondary coupling body is provided with a projection that engages behind the inner edge of the locking passage in the dynamic state (ii) of the locked assembly, said projection being configured as a downward-directed projection provided on an underside of the secondary coupling body.

6. The reclosable container according to claim 1, wherein in the static state (i) of the locked assembly, an upper side of the secondary coupling body is located 0.2 mm to 2.5 mm from an upper part of the receiving space, and an underside of the secondary coupling body is located 0.2 mm to 2.5 mm from the inner edge of the locking passage.

7. The reclosable container according to claim 1, wherein the receiving space comprises a roof part that is directed slanting downwards towards an access side of the receiving space.

8. The reclosable container according to claim 1, wherein each secondary coupling body comprises an upper side, said upper side, in the static state (i) of the locked assembly, being directed slanting downwards towards a respective one of the side flaps.

9. The reclosable container according to claim 1, wherein, in the static state (i) of the locked assembly, each side flap is movable between the unlocking and the locking position, and in said movement the secondary coupling body goes past the inner edge of the locking passage without coming into contact with it and the secondary coupling body also does not come into contact with a wall surrounding the receiving space.

10. A reclosable container comprising an assembly of a bin and a separate cover that is designed to close and lock the bin, wherein the bin comprises a bottom wall and a vertical side wall connected thereto, said side wall comprising an upper zone that surrounds an access opening of the bin;

wherein the cover comprises an upper surface that is dimensioned to cover the access opening of the bin, wherein a perimeter of the upper surface is provided with a cover profile, said cover profile being formed complementary to the upper zone of the bin, so that the cover profile can be placed abutting on the upper zone of the bin in order to close the access opening of the bin;

wherein two opposite outer sides of the cover profile are each provided with a side flap wherein each side flap is connected tiltably to the cover profile in such a way that each side flap can be placed in a locking position and in an unlocking position, wherein the bin and cover form a locked assembly when both side flaps are in the locking position;

wherein each side flap is provided on an inner side with a universal coupling body that extends from the inner side and, when each side flap is put in the locking position, projects through a locking passage in the cover profile, and extends thereby into a receiving space that is provided on each of the two opposite outer sides of the upper zone of the bin, wherein the universal coupling body is of a bendable configuration, so that:

i) in a static state of the locked assembly of the bin and the cover, the universal coupling body occupies an inactive position relative to the locking passage, while it is in close contact with the receiving space and thus achieves a primary locking, and ii) in a dynamic state of the locked assembly of the bin and the cover wherein the assembly is exposed to an impulse, as a result of which the universal coupling body is bent to an active position so that the universal coupling body engages behind an inner edge of the locking passage, so that a secondary locking between cover and bin is achieved.

11. The reclosable container according to claim 10, wherein the dynamic state (ii) of the locked assembly comprises a fall of the locked assembly onto the ground, wherein during the fall, the locked assembly ends up upside down on the ground, and wherein during the fall the cover comes into direct contact with the ground.

12. The reclosable container according to claim 10, wherein, in the dynamic state (ii) of the locked assembly, the impulse has the result that the receiving space collides with the universal coupling body, wherein a roof part of the receiving space collides with an upper side of the universal coupling body.

13. The reclosable container according to claim 10, wherein in the dynamic state (ii) of the locked assembly, the universal coupling body is bent downwards.

14. The reclosable container according to claim 10, wherein the universal coupling body is provided with a projection that engages behind the inner edge of the locking passage in the dynamic state (ii) of the locked assembly, said projection being configured as a downward-directed projection provided on an underside of the universal coupling body.

15. The reclosable container according to claim 10, wherein in static state (i) of the locked assembly, an upper side of the universal coupling body is in clamping contact with an upper part of the receiving space, and an underside of the universal coupling body is located 0.2 mm to 2.5 mm from the inner edge of the locking passage.

* * * * *